United States Patent [19]

Galluzzi

[11] 4,078,710

[45] Mar. 14, 1978

[54] TOOLS FOR DRIVING NAILS AND THE LIKE

[75] Inventor: Giovanni Galluzzi, Lecco (Como), Italy

[73] Assignee: Poly Patent Aktiengesellschaft, Vaduz, Liechtenstein

[21] Appl. No.: 632,996

[22] Filed: Nov. 18, 1975

Related U.S. Application Data

[63] Continuation of Ser. No. 472,704, May 23, 1974, abandoned.

[51] Int. Cl.[2] ..... B25C 1/14

[52] U.S. Cl. ..... 227/10

[58] Field of Search ..... 227/8, 9, 10, 11; 123/23, 24 A; 102/99, DIG. 1, DIG. 5

[56] References Cited

U.S. PATENT DOCUMENTS

| | | | |
|---|---|---|---|
| 2,740,385 | 4/1956 | Haage | 102/DIG. 5 |
| 2,947,221 | 8/1960 | Griffin et al. | 102/DIG. 5 |
| 3,283,657 | 11/1966 | Kvavle | 227/9 |
| 3,468,466 | 9/1969 | Wackrow | 227/10 |

*Primary Examiner*—Granville Y. Custer, Jr.
*Attorney, Agent, or Firm*—Diller, Brown, Ramik & Wight

[57] ABSTRACT

The invention relates to a nail driving tool, acting by means of an explosive charge, which, besides the normal component parts, comprises an explosion chamber of particular shape and volume, whereby a blow applied to the rear end of the tool causes the explosive charge, compressed by the rear end of the nail driving piston in the explosion chamber, to reduce the volume of the latter according to a predetermined ratio, which reduction, in turn, originates the ignition of the explosive charge.

8 Claims, 6 Drawing Figures

TOOLS FOR DRIVING NAILS AND THE LIKE

This application is a continuation of my copending U.S. application Ser. No. 472,704, filed May 23, 1974, now abandoned.

This invention relates to a tool for driving nails and the like by means of an explosive charge, and more particularly to an improvement in the explosion chamber of the explosive charge.

Tools for driving nails or other types of pins by the action of an explosive charge are well known and are generally classified into two general categories, i.e. those of "hammer" operation in which a piston sliding in the barrel hits the head of the nail or other pointed element to be driven, following the explosion of an explosive charge in the explosion chamber situated upstream of the piston, and those in which the piston is already initially in contact with the head of the nail, which is thus driven without a percussion action on its head.

It is also well known that the majority of these tools have been and are constructed so as to use explosive powder charges suitably contained in a cartridge, because of which the tool must also be provided both with a suitable striker mechanism operated by a trigger, and means for expelling the cartridge case, together with the other requirements which characterize an actual firearm. Because of the use of these tools, in particular in the building and carpentry field, great importance is given to the operational safety and accident prevention aspect, which consequently further complicates the already complicated structure of the tool.

Recently tools have been used for driving nails and pins based on the use of explosive powder charges without a cartridge case, in which the charge made up in the form of a tablet, is introduced into a suitable cavity forming the explosion chamber and comprising a protuberance arranged to operate as a striker. At the moment of use, after introducing the nail through the mouth of the barrel assembly, the opposite end of the tool is struck with a certain energy and causes the charge to ignite with the consequent explosion, the energy of which is communicated to the piston and from this to the nail.

Certain problems and disadvantages have been encountered with these tools, which may be briefly summarized as follows:

a. The explosive powder tablets, because of the requirements of storage and subsequent handling by the operator using the tool, are normally covered with a protective paint which prevents the tablets agglomerating together during their preservation in the store and enables the operator to handle the tablet without danger; however the presence of the layer of protective paint reduces the sensitivity of the explosive charge with respect to the percussion of the tool, and leads particularly to a certain non-uniformity of behavior of the tablets at percussion.

b. When the charges explode by percussion, it is difficult to concentrate the percussion energy in the most possible localized manner if the tool is to be kept simple with respect to the complicated structures characteristic of firearms.

c. The degree of reliability of the tools known up to the present time and constructed for use with powder explosive charges without cartridge cases, especially from the point of view of their continual operation, is not satisfactory from the point of view of industrial application.

The main object of the present invention is to provide a tool for driving nails and similar pins, arranged to use explosive powder charges in the form of tablets without cartridge cases, the operation of which is entirely safe and independent of the percussion energy applied to the end of the tool. More particularly the object of the present invention is to improve the explosion chamber of a tool for driving nails and similar pins in such a manner that the explosion of an explosive charge without a cartridge case takes place reliably each time the tool, made ready by the introduction of the explosive charge into the explosion chamber and of a nail or pin at the end of the barrel assemby, is struck at the opposite end.

These objects and others which will be more evident from the detailed description given hereinafter, are attained by a tool for driving nails and pins into a hard material, of the type including a housing or casing having projecting from its front a barrel assembly in which there is slidably housed a driving piston, the rear end of the piston terminating adjacent an explosion chamber formed in a breech which is arranged for rapid removal from the casing to give easy access to the explosion chamber for the loading of a tablet without cartridge case The breech is mounted for movement relative to the piston of the desired extent along the axis of the barrel assembly following a blow applied to the rear end of the breech, in such a manner as to advance the bottom of the explosion chamber relative to the rear end of the piston. The explosion chamber is defined at its front and sides by the casing and by the rear end of said driving piston while its rear wall is formed by the front part of the breech. The explosion chamber has at its rear wall a seat arranged to receive the explosive charge and a compression cavity of solid bottom communicating with the seat, and situated with respect to the seat on the side opposite the rear end of said driving piston. The compression cavity has a volume such that when the breech is moved axially under the action of a blow applied to its rear end, that part of the explosive charge compressed by the rear end of the piston in the compression cavity reduces the volume of the compression cavity in accordance with a preset ratio to effect thermal ignition of the explosive charge.

In a first preferred embodiment of the present invention said receiving seat also constitutes a stop on which the peripheral band of the explosive charge rests, while the piston comprises a cylindrical protuberance arranged to penetrate for a certain depth into said compression cavity. In this manner, when the rear end of the breech is struck and said rear protuberance of the piston engages with the central zone of the explosive charge, this latter is firstly deformed and then, at least partially, cut and forced into the compression cavity, without the air contained in this latter being able to escape.

In relation to the preferred embodiment previously described, a compression cavity shown to be particularly advantageous is one having a composite form, i.e. a frustum plus a cylinder, the cylindrical part being that which closes the cavity. In addition, in the case of this compression cavity, it is preferable for the protuberance of the piston to be of cylindrical shape and having a diameter such as to penetrate for a predetermined length into the inside of the frustum part of the compression cavity.

The present invention will now be described in relation to the accompanying drawings which illustrate a preferred embodiment, it being understood that this illustration is given by way of non-limiting example only. In the drawings.

Figure 1:
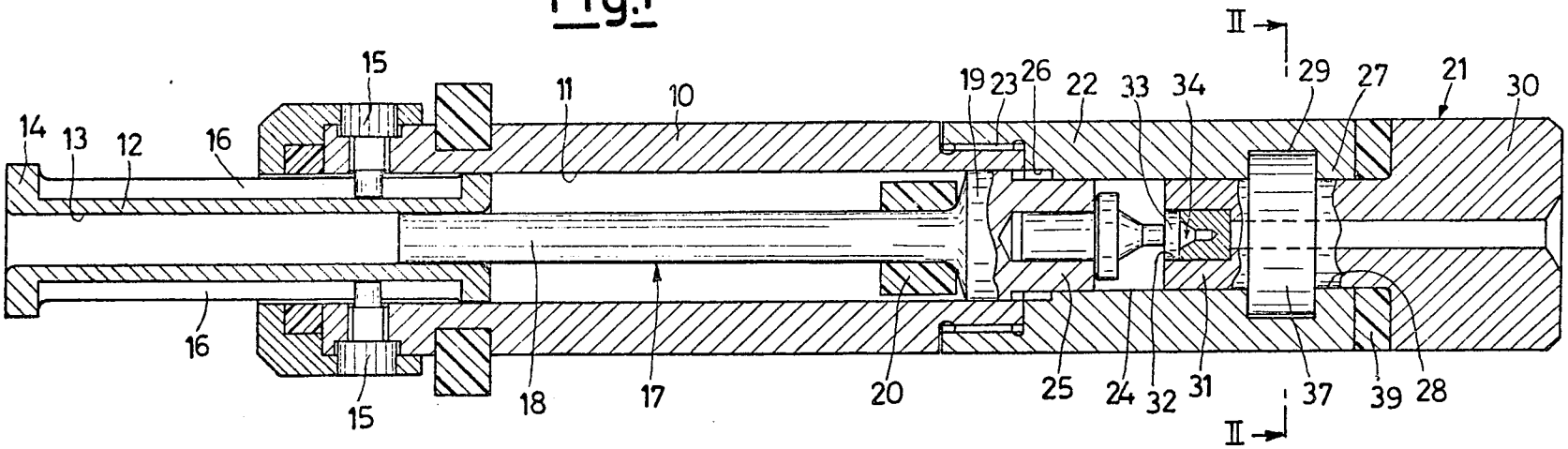
FIG. 1 is a longitudinal axial section through the tool for driving nails and the like according to the present invention.

Referring firstly to FIGS. 1-4, the tool for driving nails according to the present invention comprises a casing 10 of cylindrical shape with an axial through bore 11, in which is slidably housed a barrel assembly 12 also comprising an axial through bore 13. The barrel assembly is kept from projecting into the casing 10 by a front flange 14 having an external diameter greater than the diameter of the through bore 11 of the casing 10. It is evident that, as is usual in the art, the barrel assembly is slidably mounted in the casing for the purpose of enabling the tool to be adapted to different lengths of nail or pin to be driven. For adjusting the position of the barrel assembly with respect to the casing 10, two diametrically opposite screws 15 are provided which passes through suitable holes made in the wall of the casing 10 and adapted to frictionally interact with two corresponding longitudinal grooves 16 formed in the surface of the barrel assembly. The two grooves 16 do not extend the entire length of the barrel assembly, thereby serving the purpose of preventing the barrel assembly from sliding out of the casing 10.

Inside the casing 10 is slidably mounted a piston 17, consisting of a rod 18, arranged to slide inside the barrel assembly 12, and a rear part or head 19 of diameter greater than the rod 18 and arranged to slide in the bore 11 of the casing 10. On the rod 18, close to the head 19, is mounted a pad 20 the purpose of which is to soften the blow of the head 19 against the rear end of the barrel assembly 12 when the piston 17 terminates its working stroke of driving the nail into the working material.

As can be clearly seen in FIG. 1, the tool also comprises a breech 21 and an intermediate section 22 between the breech and casing 10.

The section 22 is removably joined to the casing 10, for example by means of the thread 23, so as to enable the tool to be rapidly and easily dismantled for maintenance and/or repair purposes. In the section 22 there is an axial bore 24 which constitutes the extension of the axial bore 11 of the casing 10. This axial bore, which has a diameter smaller than the head 19 of the piston 17, has however, a diameter such as to slidably receive the rear portion 25 of the piston itself, the rear portion 25 having a smaller diameter than the head 19. It is important to observe that the axial bore 24 of the section 22 comprises at its front an enlarged part 26 of diameter equal to the head 19 of the piston 17 and having an axial length suitably dimensioned for the purpose which will be described hereinafter. The rear part of the section 22 is closed by a cap shaped portion 27, including an end wall in which there is a slot type aperture (FIG. 2) 28. Upstream of the portion 27 the wall of the section 22 has formed therein a groove 29 for removably locking the breech 21 to the section 22 in a manner to be described hereinafter.

The breech 21 comprises a solid cylindrical part 30 from which a shaped portion 31 projects frontwards arranged for introduction into the section 22 through the aperture 28. The portion 31, which defines the explosion chamber and the compression cavity, to be described hereinafter, is connected to the cylindrical part 30 by a locking part 37 having projecting fins for interlocking with the section 22 in the groove 29. The central portion of the locking part 37 has a cross sectional dimension not greater than the internal bore of the section 22 and such as to pass through the aperture 28 of the cap shaped portion 27 of the section 22.

Figure 6:
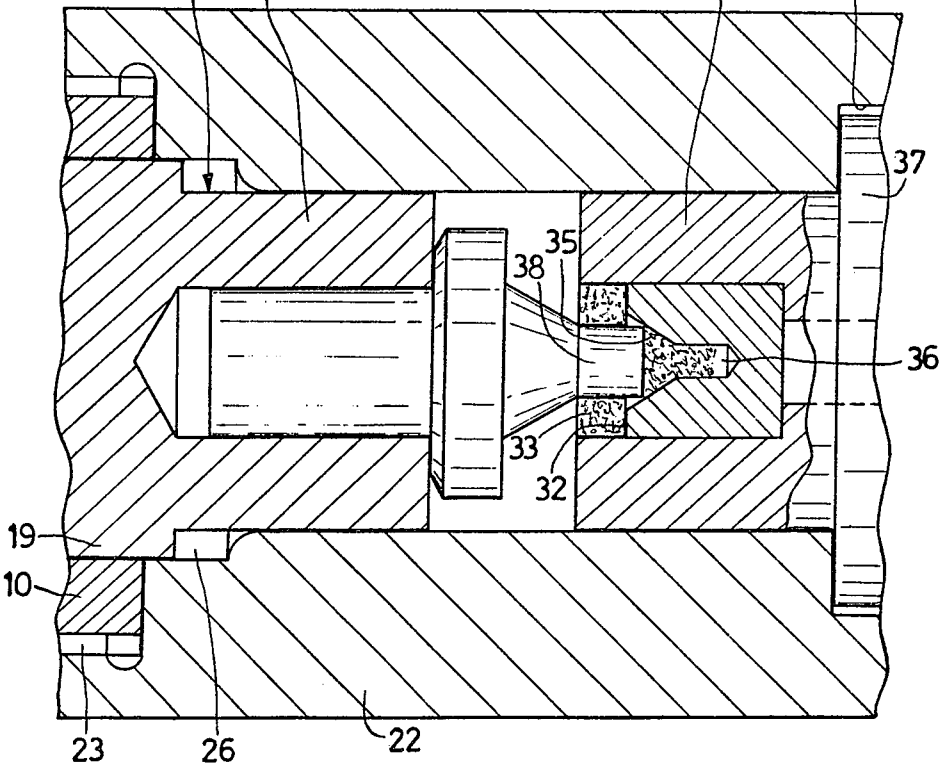
FIG. 6 is a view analogous to FIG. 3 which shows the tool in the condition immediately preceding the explosion.
Figure 2:
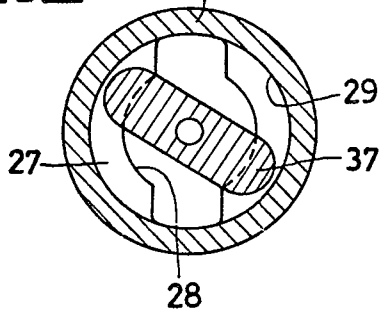
FIG. 2 is a section on the line II—II of FIG. 1.
Figure 5:
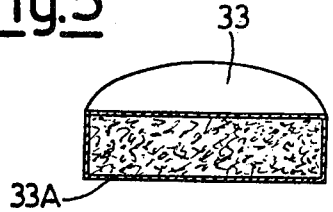
FIG. 5 is a partially sectional perspective view of an explosive charge particularly suitable for use with the tool according to the present invention.
Figure 4:
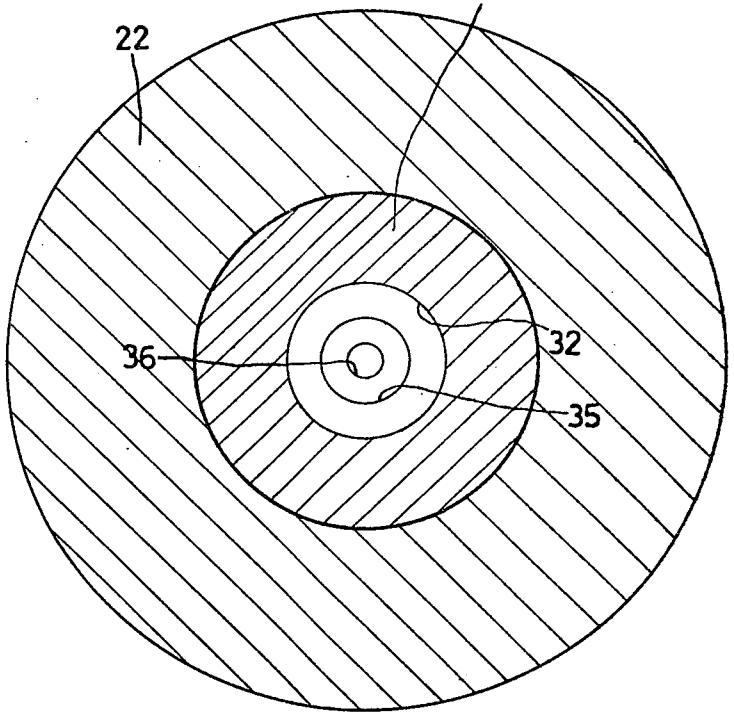
FIG. 4 is a cross-section on the line IV—IV of FIG. 3.
Figure 3:
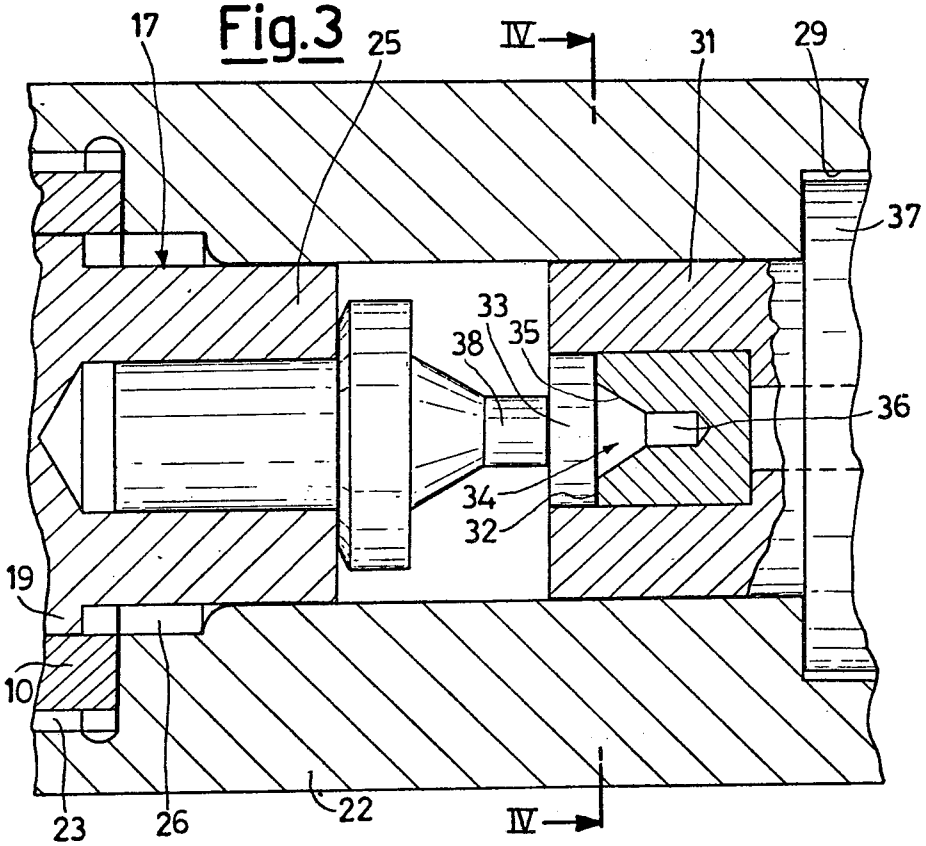
FIG. 3 is a section to an enlarged scale of the explosion chamber and compression cavity of the tool of FIG. 1.

In the front face of the shaped portion 31 of the breech 21 there is an annular seat 32 designed to receive the explosive charge 33 (FIG. 5) which is covered with protective paint **33*a*. In effect, as shown in FIG. 6, the seat 32, besides positioning the explosive charge by supporting a peripheral ring portion of it, has a bore defining the mouth of a compression cavity 34 the purpose of which is to start the explosion. The compression cavity, as shown in FIG. 3, comprises a frustum first part 35 which terminates in a cylindrical part 36, which constitutes the closed bottom of the compression cavity 34**.

The seat 32 is opposed by the rear end of the piston 17 which carries a firing member including a preferably cylindrical protuberance 38 of external diameter less than the internal diameter of the annular seat 32 and preferably less than the maximum internal diameter of the frustum part 35 of the compression cavity 34. In the drawings the protuberance or projection 38 is shown in the form of an insert inserted into a suitable seat formed in the rear part 35 of the driving piston 17. In addition, mainly for reasons of balancing and disposition of the masses, the protuberance 38 is suitably connected to the portion 25 of said piston.

The tool previously described in relation to a preferred embodiment operates in the following manner:

The length by which the barrel assembly 12 projects from the front end of the casing 10 is suitably adjusted in relation to the length of the nail to be driven so that there is no break in continuity, in the rest position, between the breech 21, the driving piston 17, the nail (not shown) and the hard material into which the nail is to be driven. It is evident that the material into which the nail is to be driven must have a certain hardness so as to react without yielding to the blow applied to the rear end of the breech. This is obviously very important from the point of view of accident prevention, as is well known in this specific field.

After introducing the nail through the mouth of the tool (and in this respect it must be observed that the nails normally used in connection with tools of this type are provided with a cap or a fin projecting laterally so as to prevent the loss of the nail from the tool by gravity), and after separating the breech from the section 22, thereby uncovering the seat 32, an explosive charge 33 is placed in this latter and the breech is closed on the section 22 by introducing the shaped portion 31 of the breech through the slotted aperture 28 in the bottom of the section 22. To lock the breech 21 it is sufficient to rotate the breech through a predetermined angle until the fin parts 37 can no longer emerge through said slotted aperture. To improve this locking and avoid the accidental and undesirable withdrawal of the breech from the section 22, between the part 30 of the breech and the bottom 27 of the section 22 there is a suitable thickness of rubber or other resilient material 39 which is compressed when the breech 21 is locked in place.

The tool is now ready for operation, and after being rested with its barrel assembly end against the material into which the nail is to be driven, a blow is applied to the rear end of the solid cylindrical part 30 of the breech. Tests have been shown that invariably the blow is followed by the explosion of the explosive charge and the driving of the nail.

Without limiting the present invention to a precise and particular explanation of the mechanism by which the explosion takes place, it is considered that, in consideration of the particular shape of the explosion chamber and especially of the fact that contrary to the usual state of things there are not two solid continuous parts present between which the explosive charge is imprisoned at the moment of the blow and the explosion. In other words, there is no true "anvil" against which the explosive charge abuts when struck by the projection 38 and the explosion of the charge does not take place in the conventional manner, but instead the explosion of the charge may be justified by the following hypothesis.

With reference to FIG. 1, when the breech is struck, for example by the blow of a hammer, the breech 21, the section 22 and the casing 10 move axially with respect to the barrel assembly 12, the piston 17 and the nail, the movement being of length equal to the longitudianl extent of the enlarged part 26. Consequently, the seat and the compression cavity are made to approach the protuberance 38 of the piston which initially deforms and subsequently cuts the central zone of the explosive charge 33, i.e. that which covers the mouth of the compression cavity 34. At the end of the axial movement of the breech 21, the section 22 and the casing 10, the protuberance 38 will have penetrated to the inside of the frustum section 35 of the compression cavity until it comes into contact or nearly into contact with the wall of this latter, as shown in FIG. 6. During this movement and because of the deformation and subsequent cutting of the central part of the explosive charge 33, the air contained in the compression cavity 34 cannot escape laterally and is compressed at a predetermined compression ratio, and because of the rapidity of the action, the air becomes heated by well known thermodynamic laws to a high temperature, which temperature is higher than the limit of inflammability of the explosive powder which constitutes the charge 33. Thus, the tool according to the present invention always operates reliably in spite of the reduced sensititivity of the explosive charges.

The hypothesis formulated above is confirmed by a practical test of comparison, in which a small hole has been made in the closed bottom of the compression cavity 34 such as to put the cavity into communication with the outside or at least considerably reduce the compression ratio obtainable. By carrying out this test with explosive charges in conditions of perfect preservation and applying the blow to the breech with the maximum possible energy, it has been found that the explosion of the explosive charge does not take place.

It is further considered that together with the thermal effect consequent on the compression of the air in the compression cavity, the cutting of the explosive charge has the effect of uncovering a band of explosive substance not covered by the insulating paint and consequently much more easily inflammable.

From the previous description it is clear that the relative dimensions of the compression cavity and the enlarged part 26 of the internal bore of the section 22 are related to the compression ratio which is to be obtained for the air contained in the compression cavity 34 at the moment of operation of the tool. Practical tests have established that the best results are obtained when this compression ratio is about 20:1, i.e. when the volume of the compression cavity at the end of the approach stroke of the breech 21, the section 22 and the casing 10 relative to the piston 17 is reduced to about one twentieth of the initial value. Obviously, however, the choice of this ratio will depend on other factors such as for example the inflammability and especially the temperature of inflammability of the explosive charge, the quantity of explosive powder constituting each charge, etc.

One advantageous aspect of the present invention lies in the fact that the tool is readily adaptable to explosive charges which are different both in shape and in power, it being sufficient simply to replace the breech with another in which the seat and/or the terminal rear section of the driving piston 17 carrying the cylindrical protuberance 38 are of suitable shape and size.

It must also be emphasized that in the preceding description explicit reference has been made to a particular embodiment of the receiving seat and compression chamber. It is clear that these are susceptible to variations well within the range of the expert of the art, provided the principle of the compression of a certain quantity of air is safeguarded and this compression takes place in the ratio previously defined with sufficient rapidity.

Finally explicit reference must be made to the fact that the present invention is not limited to the use of the particular tool for driving nails and other pins as previously described and illustrated, but may clearly find application, with regard to the structure of the explosion chamber and the construction of a receiving seat coupled with a compression cavity, to other cases in which the explosion of the explosive charge is required to be made independent of the force of percussion exerted on the charge itself.

In fact it cannot be denied that the fundamental and absolutely surprising characteristics of the present invention lies in the fact that while the action of the protuberance 38 on the explosive charge 33 takes place on one side of the charge, ignition of the charge occurs on the opposite side of the charge due to the thermal effect of compressing the air entrapped in the compression cavity 34.

I claim:

1. A device for firing an explosive charge of the tablet type free of a cartridge case and rim fire means, said device comprising a breech, a firing member, and mounting means mounting said breech and firing member for relative movement; said breech including an apertured seat for receiving an explosive charge in tablet form, and a closed compression cavity rearwardly of said seat, and said firing member including protuberance means passable axially through said seat and into said compression cavity for forcing a portion of an explosive charge seated on said seat into said compression cavity and for compressing air entrapped in said compression cavity to a degree to thermally ignite the explosive charge, said seat aperture defining a mouth of said compression cavity and said protuberance means being in the form of a projection of a lesser cross section than that of said seat aperture, said compression cavity is of a reducing cross section, said compression cavity including a small cross sectional portion remote from said apertured seat, and has a reducing tapered portion between said small cross sectional portion and said apertured seat.

2. A device according to claim 1 wherein said cross section of said projection is greater than the cross section of said small cross sectional portion.

3. A device according to claim 1 wherein said compression cavity reducing tapered portion is in the form of a frusto conical outer portion and said compression cavity small cross sectional portion is in the form of a generally cylindrical inner portion, said outer portion including inner and outer diameters of different sizes, and said projection is of a diameter of a size intermediate the sizes of said inner and outer diameters.

4. A device according to claim 1 wherein said mounting means includes a casing defining a cylindrical chamber, said breech closing one end of said chamber with said seat opening into said chamber, and said firing member including a piston slidable in said chamber and closing the other end of said chamber, the space within said cylindrical chamber between said breech and said piston defining a combustion chamber.

5. A device according to claim 4 together with a barrel assembly carried by said casing remote from said breech for receiving a projectile, and a rod connected to said piston for movement therewith and axially slidable in said barrel assembly for projecting a projectile from said barrel assembly.

6. A device according to claim 5 together with a quick disconnect connection between said breech and said casing for facilitating the removal of said breech from said casing for cleaning and reloading.

7. A device according to claim 5 wherein means releasably mount said barrel assembly relative to said casing for axial adjustment relative to said piston and said breech to control the effect length of said barrel assembly relative to said rod wherein a projectile positioned in said barrel assembly will form a temporary stop for said piston and said protuberance means as said breech is axially advanced.

8. A device for firing an explosive charge of the tablet type free of a cartridge case and rim fire means, said device comprising a breech, a firing member, and mounting means mounting said breech and firing member for relative movement; said breech including an apertured seat for receiving an explosive charge in tablet form, and a closed compression cavity rearwardly of said seat, and said firing member including protuberance means passable axially through said seat and into said compression cavity for forcing a portion of an explosive charge seated on said seat into said compression cavity and for compressing air entrapped in said compression cavity to a degree to thermally ignite the explosive charge, said compression cavity including a mouth and an inner portion remote from said mouth of a reduced cross section as compared to the cross section of said mouth, and said inner portion having a closed inner end defining a space into which entrapped air is compressed, said mouth being materially larger in cross section than that of said protuberance means.

* * * * *